United States Patent [19]

Cuthbert et al.

[11] Patent Number: 4,692,987

[45] Date of Patent: Sep. 15, 1987

[54] METHOD OF CONSTRUCTING A CABINET FOR AN AUTOMATIC WASHER

[75] Inventors: Victor W. Cuthbert; Joel M. Snider, both of Lincoln Township, Berrien County, Mich.

[73] Assignee: Whirlpool Corporation, Benton Harbor, Mich.

[21] Appl. No.: 862,710

[22] Filed: May 13, 1986

Related U.S. Application Data

[62] Division of Ser. No. 558,875, Dec. 7, 1983, Pat. No. 4,618,193.

[51] Int. Cl.[4] ..... B21D 39/00; B23P 19/04

[52] U.S. Cl. ..... 29/455 R; 29/434; 403/106

[58] Field of Search ..... 29/434, 451, 453, 455 R; 312/257 R, 263, 257 A, 108, 257 SM, 264, 257 SK; 403/106

[56] References Cited

U.S. PATENT DOCUMENTS

| | | | |
|---|---|---|---|
| 676,509 | 6/1901 | McNown | 312/263 |
| 852,699 | 5/1907 | Bonsall | 312/257 R X |
| 881,673 | 3/1908 | Ellison | 312/263 X |
| 972,476 | 10/1910 | Senge | 312/263 X |
| 2,019,045 | 10/1935 | Chafee | 29/455 R X X |
| 2,276,139 | 3/1942 | Anderson et al. | 29/455 R UX |
| 2,866,676 | 12/1958 | Goebel . | |
| 3,006,066 | 10/1961 | Grossen et al. | 29/455 R X |
| 3,337,983 | 8/1967 | Ebstein . | |
| 3,347,609 | 10/1967 | Mann . | |
| 3,717,396 | 2/1973 | Dupree . | |
| 3,749,465 | 7/1973 | Newcomer | 312/257 R X |
| 3,760,970 | 9/1973 | Lutz . | |
| 4,128,354 | 12/1978 | Amrogowicz | 312/257 SM X |
| 4,153,311 | 5/1979 | Takahashi | 312/257 R X |
| 4,173,379 | 11/1979 | Van der Heiden | 312/257 SM X |
| 4,307,588 | 12/1981 | Smith et al. | 312/257 SM X |
| 4,319,713 | 3/1982 | Suttles | 312/257 R |

FOREIGN PATENT DOCUMENTS

| | | | |
|---|---|---|---|
| 268353 | 12/1964 | Australia | 312/108 |
| 1,423,935 | 11/1965 | France | 312/263 |
| 2426224 | 1/1980 | France | 312/108 |

*Primary Examiner*—Charlie T. Moon

*Attorney, Agent, or Firm*—Hill, Van Santen, Steadman & Simpson

[57] ABSTRACT

A cabinet construction for domestic appliances is provided in which four vertical side panels are secured to a horizontal base panel and each other by interlocking slot and tab means and two restraining bars securing the top ends of the side panels. A top panel is securable by slot and tab means and resilient snap fasteners so that the entire cabinet can be quickly and easily assembled and disassembled. One or more of the side panels can be removed during operation of the appliance to view the interior mechanism for assistance in servicing.

3 Claims, 10 Drawing Figures

METHOD OF CONSTRUCTING A CABINET FOR AN AUTOMATIC WASHER

This is a division of application Ser. No. 558,875 filed Dec. 7, 1983 now U.S. Pat. No. 4,618,193.

BACKGROUND OF THE INVENTION

1. Field of the Invention

The present invention relates to cabinet construction for a home appliance and more particularly to multiple piece cabinet construction.

2. Description of the Background Art

Cabinets commonly used for home appliances and in particular for washing machines generally have a cabinet having four vertical walls secured to each other or to a frame and a top wall secured to the top of the four side walls. One or more of the walls may be removed or pivoted open for access into the interior of the machine.

Standard cabinets generally require a number of fasteners such as bolts or screws to hold each of the walls together in alignment and to hold all the walls in alignment with respect to the appliance frame. The use of these fasteners results in high manufacturing costs because of necessary assembly time and high servicing costs due to disassembly and reassembly time.

Cabinets or containers made of multiple panels are known from U.S. Pat. No. 3,760,970, which discloses a box construction which utilizes three panels, slidable for engagement with a base member and another panel, and a fourth panel engagable after the other three have been assembled. The panels are tied together by a top structure.

SUMMARY OF THE INVENTION

The present invention provides a cabinet construction for domestic appliances which allows for ease of assembly and ease of servicing because the side panels can be easily removed, and the interior components of the appliance observed while the machine is operating. A base member of the appliance is provided with tabs which are received in folded edges of the front, rear and two side panels. The front and rear panels are positioned by leaning the panels with the top end away from the base member, positioning the slots in the folded edge over the tabs of the base member and sliding the panel laterally as far as possible. After sliding to the proper position, the panels are rotated to the vertical position. The first tab locates the front and rear panels and holds them against vertical movement. Once rotated to the vertical position, a second tab prevents horizontal movement of the panels. A tie brace is used to tie the front and rear panels together at their upper ends. With this much of the cabinet assembled, visual inspection of all of the functioning appliance components can be made.

The side panels are located by a third tab in the base and by a side panel locating lock. The third tab restricts horizontal movement of the side panel and the locating lock restricts vertical movement of the panel. Once assembled, the side panels are tied at their upper ends to the tie braces.

DESCRIPTION OF THE PREFERRED EMBODIMENTS

Figure 1:
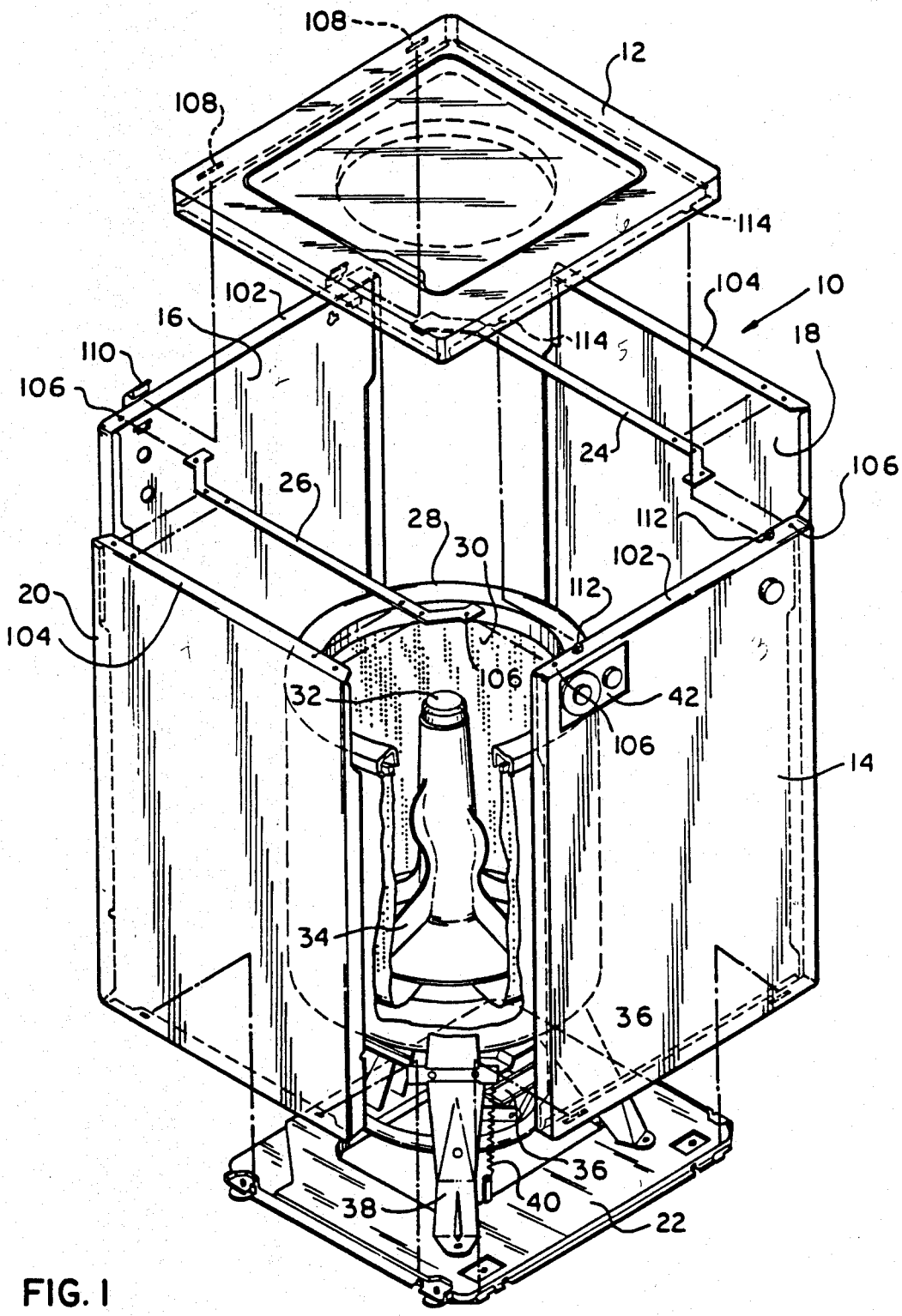
FIG. 1 is an exploded perspective view of a washing machine embodying the principles of the present invention.

FIG. 1 shows an exploded view of a washing machine generally at 10 which has a cabinet comprised of a top panel 12, a front panel 14, a rear panel 16, a right side panel 18, a left side panel 20 and a base panel 22. A right retaining bar 24 and a left retaining bar 26 are provided for securing the front, rear and side panels together. Interior of the cabinet is a laundry mechanism which comprises an imperforate tub 28 which surrounds and is concentric with a perforate basket 30. A vertical agitator 32 with agitating vanes 34 is drivingly mounted along the central axis of the washer tub 28 and basket 30 and is driven by an electric motor 36 through a transmission. Supporting legs 38 are provided which are attached at their top end to a supporting mechanism for the tub 28 and at their lower ends to the base panel 22. Suspension mechanisms 40 are associated with the legs 38 to dampen the vibration produced by the rotating and oscillating mechanisms of the washer.

Cycle selector and control switches 42 are mounted on the front panel 14 for manipulation by a user to program the washer to operate through an automatic series of washing, rinsing and drying steps.

Figure 2:
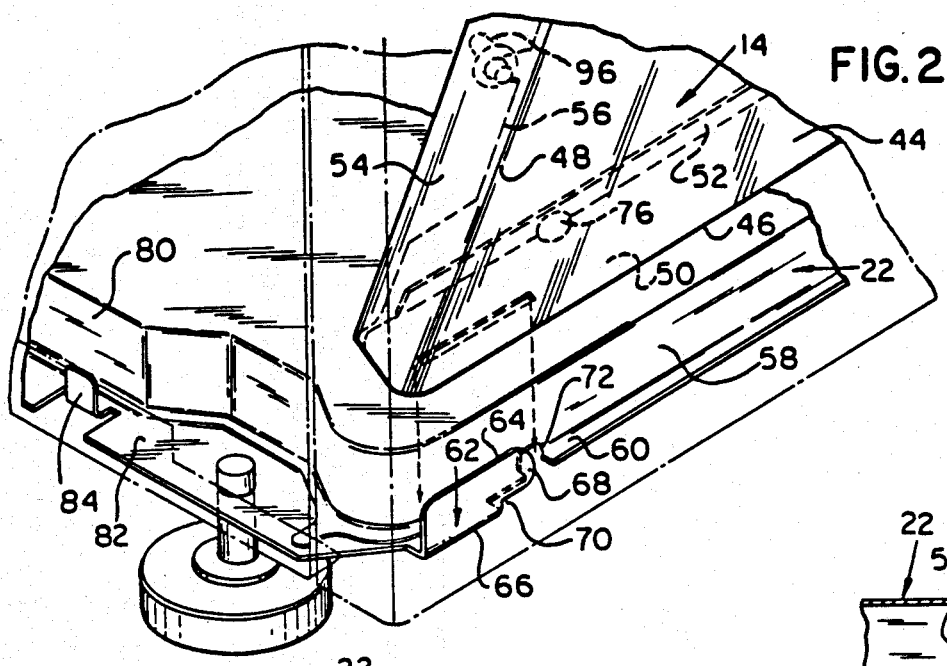
FIG. 2 is a partial perspective view showing the base of the appliance and a first panel being assembled.

The assembly of the front and rear panels is shown in greater detail beginning in FIG. 2 where it is seen that the front panel 14 is comprised of a sheet material such as sheet metal and has a front face or wall 44 with a bottom edge 46 and a side edge 48. The sheet material is bent around the bottom edge to form a narrow bottom wall 50 formed at right angles to the front wall 44. The bottom wall 50 has an associated short rear wall 52 which is formed at right angles to the bottom wall 50 and which extends upwardly parallel to the front wall 44.

A side wall 54 is formed at the edge 48 of the front wall 44 which extends a short distance perpendicularly rearward from the front wall 44. The side wall 54 has an associated rear wall 56 which is formed at right angles thereto and extends parallel to and in the same direction as the front wall 44.

The base panel 22 has a short vertical wall 58 which extends across the width of the base and also has a narrow horizontal ledge 60 extending forwardly from the vertical wall 58. Near the right and left ends of the front of the base 22 and extending from the horizontal ledge 60 are vertically disposed tabs 62 which have an upper laterally oriented edge 64 wider than a lower edge 66 which is connected to the ledge 60. A nose portion 68 extends to the right near the top of the tab and is cut away at 70 along the bottom edge of the tab to provide the greater upper width. Two second smaller and rectangular tabs 72 are provided in the ledge 60 laterally displaced from the first tabs 62 approximately half way between the front wall 58 of the base panel 22 and the upstanding first tabs 62 such that the second tabs 72 project upwardly in the middle of the ledge 60.

A slot 74 for each tab 62 is provided in the bottom wall 50 of the front panel 14 which corresponds in width and slightly offset in position to the first tab 62 of the base panel 22. Openings 76 in the bottom wall 50 and associated rear wall 52 correspond in size and location to the second tabs 72.

Figure 4:
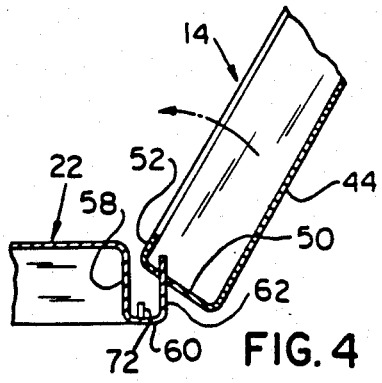
FIG. 4 is a side sectional view of the base and front panel taken generally along the lines IV—VI of FIG. 5.
Figure 3:
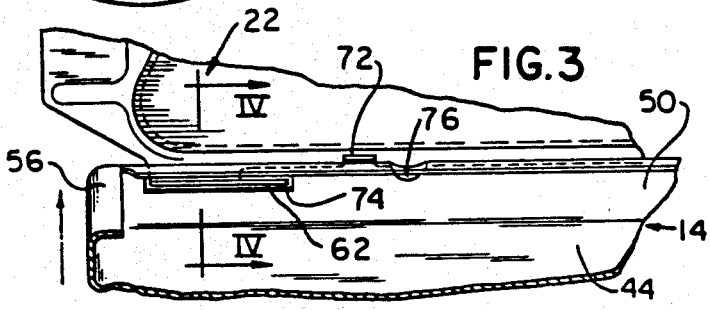
FIG. 3 is a partial top sectional view of the base and front panel being assembled.

In FIGS. 3 and 4 an initial step of assembling the front panel 44 to the base 22 is shown. The front panel 14 is guided toward the base panel 22 at an angle from the vertical such that the bottom wall 50 of the front panel 14 is closest horizontally to the base panel 22. The slot 74 in the bottom wall 50 is aligned with the tab 62 of the base panel 22 and the front panel 14 is pushed down such that the tab 62 is inserted into the slot 74 and the bottom wall rests on the ledge. As seen in FIG. 3, as this occurs, the front panel 14 will be displaced to the right relative to its final position and therefore the opening 76 in the bottom and rear walls 50 and 52 will be displaced to the right of the second tab 72.

Figure 6:
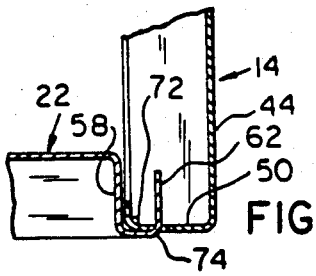
FIG. 6 is a side sectional view of the base and front panel taken generally along the lines VI—VI of FIG. 5.
Figure 5:
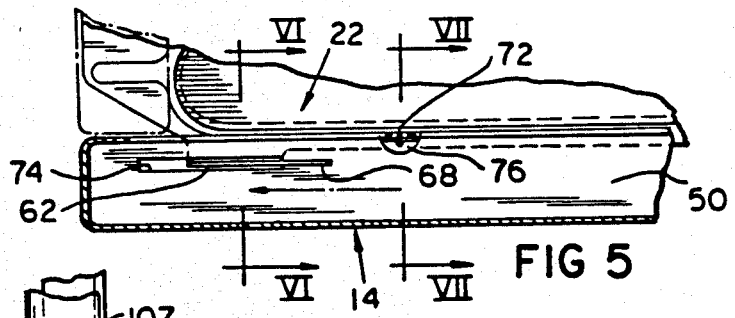
FIG. 5 is a top sectional view of the base and front panel in the assembled position.
Figure 7:
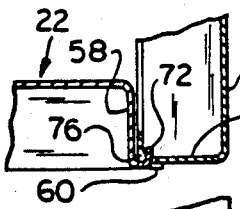
FIG. 7 is a side sectional view of the front panel and base in the assembled position shown taken generally along the lines VII—VII of FIG. 5.

Once the front panel has been pushed down far enough such that the bottom wall 50 of the front panel 14 clears the nose portion 68 of tab 62, the front panel 14 can be moved laterally to the left such that the right end of the slot 74 will slide under the nose portion 68 of tabs 62 into the cut-out area 70. This lateral movement will be stopped by the tab acting against the right end of the slot 74 and in this lateral position the front panel 14 can be rotated to the vertical position shown in FIGS. 5, 6, and 7.

In those views, it is seen that the front panel 14 is in a vertical position and the first tab 62 extends up through the slot 74 in the bottom wall 50 of the front panel. The second tab 72 is positioned within the opening 76. Also, the slot 74 is displaced to the left relative to the width of tab 62 such that the nose portion 68 of the tab 62 extends over a portion of the bottom wall 50. Therefore, the front panel 14 is restrained from lateral movement by the second tab 72 being captured within the opening 76 made just slightly larger than the tab. Also, the front panel 14 is restrained against vertical movement by the nose portion 68 of tab 62 extending over the bottom wall 50.

The rear panel 16 is assembled onto the base panel 22 in an identical manner to the front panel 14. The same tab and slot arrangement is utilized and when standing at the back of the base panel 22 inserting the rear panel 16, the manipulations are identical to standing in front of the base plate 22 and inserting the front panel 14. Thus, both the front panel 14 and back panel 16 are restrained against horizontal and lateral movement by the cooperating tabs and slots. Only a rotational movement pivoting around the bottom of the front or rear panel will be possible.

Figure 8:
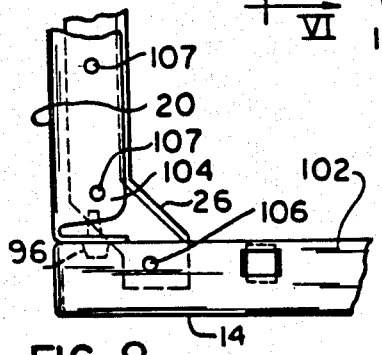
FIG. 8 is a partial top view of the front and side panels.

To stabilize the front and rear panels and to limit their rotation around their bottom edges, the two restraining bars 24 and 26 are fastened to the top wall of each of the panels. As seen in FIGS. 1 and 8 top walls 102 of the front and rear panels are engaged by the restraining bars 24 and 26. The bar 26 is positioned under the top walls 102 of the panels and corresponding openings 106 in the top walls and the bars are provided so that screws or other fastening devices can be used to secure the pieces together. Once the two bars 24 and 26 are secured in place, the front and rear vertical panels will be held in place and secured to the base panel 22. At this point in the assembly, the washing machine may be operationally tested with the interior operative mechanisms exposed.

Figure 9:
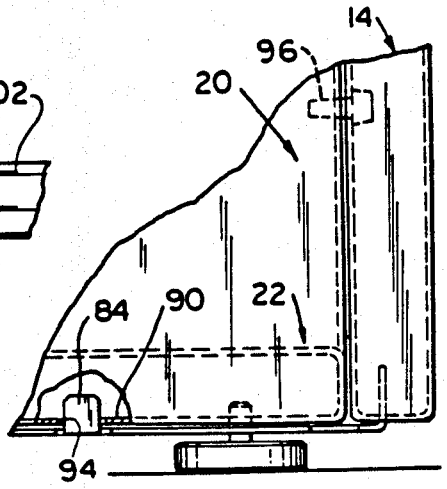
FIG. 9 is a partial side elevational view of the front and side panels.
Figure 10:
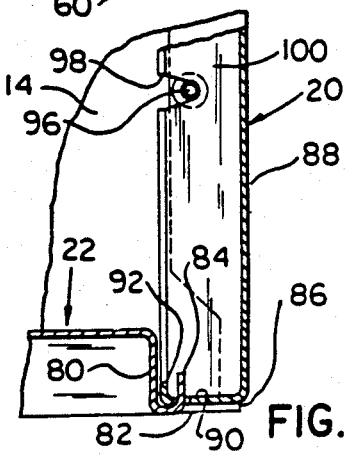
FIG. 10 is a partial rear sectional view showing the locking device between the front and side panel.

FIGS. 8, 9 and 10 show the interaction and interlocking of the side panel 20 with the front panel 14 and the base panel 22. As seen in FIG. 10, the base panel 22 has a vertical side wall 80 with a narrow horizontal flange 82 projecting outwardly therefrom. At two points along the length of the flange 82 a portion of the flange 82 is cut away and upturned to form a tab 84 which extends upwardly midway between the vertical side wall 80 and an outside edge 86 of the flange.

Each side panel 20 has a vertical outside wall 88, a horizontal bottom wall 90 and a short vertical inside wall 92 making the construction of the side panel similar to that of the front and rear panels. Formed in the bottom wall 90 are slots 94 which correspond with the size and location of the tabs 84. This tab and slot cooperation prevents horizontal movement of the side panels 18 and 20 which are made identically.

To prevent the side panels from moving vertically after assembly, locking means in the form of pins and slots are provided. Two pins 96 are mounted in each of the back walls 56 associated with the side walls 54 of the front panel 14. Similar pins are provided on the back panel. As seen in FIG. 9, the pin 96 extends beyond the edge of the side panel 20. To accommodate the pin 96, an open slot 98 is formed in a side wall 100 of the side panel 20.

The side panels are assembled onto the base panel 22 in a manner similar to that described above with respect to the front panel 14, that is, they are guided toward the base panel at an angle to vertical until the tab 84 is inserted into the slots 94. Then the panel 20 is rotated to a vertical position so that the slots 98 will engage the pins 96. In this orientation the side panel 20 will be prevented from moving in a vertical direction by the engagement of the pins 96 and the slots 98. Thus, at this point of the assembly all of the vertical panels will be held against the base panel 22 and will be restrained from horizontal or vertical movement.

As seen in FIGS. 1 and 8, to stabilize the two side panels 18 and 20 and to prevent them from rotating around their bottom edges, the two restraining bars 24 and 26 are fastened to the top wall 104 of each. The bar 26 is positioned under the top walls 104 of the side and corresponding openings 107 in the top walls and the bars are provided so that screws or other fastening devices can be used to secure the pieces together. Once the top walls 104 of the side panels 18 and 20 are secured in place, the panels will be held rigidly in place and secured to the base panel 22.

As seen in FIG. 1, the top panel 12 is placed onto the secured vertical panels by muting slots 108 in a back wall of the top panel 12 with corresponding hinge tabs 110 located near the top of the back panel 16. This mating is done with the top panel in a vertical orientation. The panel is then rotated into a horizontal position over the tops of the vertical panels until latches or snaps 112 secured to the top wall 102 of the front panel 14 engage with recesses 114 in a bottom lip of the top panel 12. The top panel 12 will then be held horizontally and vertically onto the tops of the vertical panels such that the entire enclosure will be secure and stable.

The snap fasteners 112 which secure the top panel 12 are resilient and can be unlatched by an appropriate force. By doing so, the top panel 12 can be removed from the enclosure for access into the interior of the tub for servicing or other reasons. With the top panel removed, the right and/or left side panels 18 and 20 can be removed leaving the retaining bars 24 and 26 supporting the front and rear panels 14 and 16. The top panel 12 may then be replaced so that the washer can be sequenced through a series of washing, rinsing and drying steps with a portion of the interior mechanism exposed. The removal of the side panels does not negatively affect the integrity of the cabinet because of the interlocking tabs and slots between each of the remaining panels, the restraining bars and the latch of the top panel. This assists in the servicing of the washing machine and the ease of entry into the interior mechanism enhances the serviceability of the appliance.

Although the cabinet construction has been shown and described with the base panel being a bottom panel and the restraining bars affixed to the top ends of the vertical panels, it is also contemplated by the present invention that the vertical and horizontal orientation of some of the panels may be reversed. In other words, the first panel or base panel may be disposed either horizontally as shown or vertically which would thereby change the orientation of the five remaining panels. Movement described above as horizontal could then be described as lateral movement and that described as vertical would become longitudinal. Thus longitudinal would mean toward or away from the plane in which the base or first panel lies and lateral would mean parallel to that plane.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of constructing a cabinet for a domestic appliance comprising the steps:

(1) positioning a base panel in a horizontal orientation,
(2) guiding a front panel toward the base panel at an angle from vertical,
(3) engaging slots in a bottom wall of the front panel with a first set of tabs protruding from the base panel,
(4) sliding the front panel laterally relative to the base panel until the tabs are captured by the bottom wall,
(5) rotating the front panel to a vertical orientation to engage a second set of tabs with openings in the front panel,
(6) repeating steps 2 to 5 for a rear panel,
(7) securing restraining bars to the top ends of the front, and rear panels,
(8) guiding a side panel toward the base panel at an angle from vertical,
(9) engaging slots in a bottom wall of the side panel with a third set of tabs protruding from the base panel,
(10) rotating the side panel to a vertical orientation to engage lock pins protruding from the front and rear panels with corresponding slots in the side panel,
(11) repeating steps 8 and 10 for a second side panel,
(12) securing the top ends of said side panels to said restraining bars,
(13) guiding a top panel toward the top of the rear panel at close to a vertical orientation,
(14) engaging slots in a rear wall of the top panel with hinge tabs protruding from the rear panel,
(15) rotating the top panel to a horizontal position over-lying the tops of the front, side and rear panels, and
(16) engaging a latch between the top panel and front panel to secure the two panels together.

2. A method of constructing a cabinet for a domestic appliance comprising the steps:

(1) positioning a base panel in a horizontal orientation,
(2) guiding a front panel toward the base panel at an angle from vertical,
(3) engaging slots in one of said panels with a first set of tabs protruding from the other of said panels,
(4) sliding the front panel laterally relative to the base panel until the tabs are captured in the slots,
(5) rotating the front panel to a vertical orientation to engage a second set of tabs protruding from one of said panels with openings in the other of said panels,
(6) repeating steps 2 to 5 for a rear panel,
(7) securing restraining bars to the top ends of the front and rear panels,
(8) guiding a side panel toward the base panel at an angle from vertical,
(9) engaging slots in one of said side or base panels with a third set of tabs protruding from the other of said side or base panels,
(10) rotating the side panel to a vertical orientation to engage locking means between said side panel and said front and rear panels,
(11) repeating steps 8 to 10 for a second side panel,
(12) securing the top ends of said side panels to said restraining bars,
(13) guiding a top panel toward the top of the rear panel at close to a vertical orientation,
(14) engaging slots in one of said top or rear panels with hinge tabs protruding from the other of said top or rear panels,
(15) rotating the top panel to a horizontal position over-lying the tops of the front, side and rear panels, and
(16) engaging a latch between the top panel and at least one of said front or side panels to secure the panels together.

3. A method of constructing a cabinet for a domestic appliance comprising the steps:

(1) positioning a base panel in a horizontal orientation,
(2) attaching a front panel along one side of the base panel,
(3) attaching a rear panel along an opposite side of the base panel,
(4) securing restraining bars between the top ends of the front and rear panels, (5) guiding a side panel toward the base panel at an angle from vertical, (6) engaging slots in one of said side or base panels with a set of tabs protruding from the other of said side or base panels, (7) rotating the side panel to a vertical orientation to engage locking means between said side panel and said front and rear panels, (8) repeating steps 5 to 7 for a second side panel, (9) securing the top ends of said side panels to said restraining bars,

(10) guiding a top panel toward the top of the rear panel at close to a vertical orientation,

(11) engaging slots in one of said top or rear panels with hinge tabs protruding from the other of said top or rear panels,

(12) rotating the top panel to a horizontal position over-lying the tops of the front, side and rear panels, and

(13) engaging a latch between the top panel and at least one of said front or side panels to secure the panels together.

* * * * *